US005970664A

United States Patent [19]

Janesky

[11] Patent Number: 5,970,664

[45] Date of Patent: Oct. 26, 1999

[54] WINDOW WELL DRAIN

[76] Inventor: Lawrence M. Janesky, 11 Fawn Meadow La., Huntington, Conn. 06484

[21] Appl. No.: 09/075,159

[22] Filed: May 8, 1998

[51] Int. Cl.[6] ..... E04F 17/06; E06B 5/02

[52] U.S. Cl. ..... 52/107; 52/169.5; 52/287.1; 52/302.3

[58] Field of Search ..... 52/107, 169.5, 52/287.1, 302.3

[56] References Cited

U.S. PATENT DOCUMENTS

| | | | |
|---|---|---|---|
| 3,304,672 | 2/1967 | Bakke . | |
| 3,344,569 | 10/1967 | Cotten . | |
| 4,265,064 | 5/1981 | Parezo | 52/169.5 |
| 4,271,648 | 6/1981 | Johnson | 52/169.5 |
| 4,757,651 | 7/1988 | Crites | 52/169.5 |
| 4,869,032 | 9/1989 | Geske | 52/169.5 |
| 4,896,467 | 1/1990 | McGinnis | 52/107 |
| 5,199,232 | 4/1993 | Chandler et al. | 52/169.5 |
| 5,339,579 | 8/1994 | Woodyer et al. | 52/107 |
| 5,367,842 | 11/1994 | Janesky | 52/169.5 |
| 5,501,044 | 3/1996 | Janesky | 52/169.5 |

*Primary Examiner*—Christopher T. Kent
*Assistant Examiner*—Yvonne Horton-Richardson
*Attorney, Agent, or Firm*—Perman & Green, LLP

[57] ABSTRACT

System for preventing the accumulation of water within exterior foundation areas, such as basement window wells, even under conditions of extreme groundwater flow. The system comprises a combination of an upper horizontal conduit section which extends out through a bore in a basement wall and opens into the dry well area within an exterior basement window well, and has an opposed end which opens at the interior surface of the basement wall, and an elongate, vertical stepped wall panel having a central stand-off conduit section and opposed vertical seat portions which sealingly-engage the interior surface of the basement wall and form therebetween the central, vertical, raised or stand-off water-conveying conduit section. The wall panel extends from an upper location, above the interior opening of the horizontal conduit, to a lower water-drainage location, preferably within a horizontal baseboard water drainage system, to permit the free flow of water from the window well, through the basement wall, and down between the raised or standoff vertical water-conveying conduit section and the wall surface into the water drainage system.

5 Claims, 2 Drawing Sheets

WINDOW WELL DRAIN

BACKGROUND OF THE INVENTION

1. Field of the Invention

The present invention relates to a system for preventing the accumulation of water in exterior areas such as basement window wells, from rain or melted snow. Recessed basement window wells are common in homes and other buildings in which the basement window extends below ground level and therefore is enclosed within a retaining wall which retains the soil to form a well area which extends below the lower level of the window frame opening. Frequently the well area is filled with stones, up to the lower level of the window frame opening, to form a dry well which assists the gravity drainage of water downwardly away from the window.

It is also common to cover window wells with clear plastic domes or covers which prevent the direct deposit of rain or snow within basement window wells. While such covers are effective for their intended purpose, they have no effect upon the migration of ground water run-off, which is the main cause of window well flooding.

Excess water accumulation or flooding of basement window wells can lead to seepage of the exterior water around and through the interface of the window and its frame, and through cracks between the frame and the foundation which are common in the area of basement windows.

2. State of the Art

It is known to prevent the accumulation of water in exterior basement window wells by means of a drain pipe system having an upper horizontal pipe section which extends from the basement, through a bore in the foundation out into a dry well within the window well. The horizontal pipe section is integral with a vertical pipe section within the basement, spaced from the interior basement wall, which drains through a hole in the basement floor.

Such system requires the existence of a sub-floor drainage system or else the water may not be able to drain through the existing soil under the floor.

An important disadvantage is that the piping extending within the basement is obtrusive, unsightly and interferes with the finishing of the basement wall and floor.

Another known system for preventing water accumulation within basement window wells, aimed at avoiding the problems of piping extending into the basement as discussed above, comprises a similar upper horizontal pipe section which extends through the foundation into the dry well of a window well area and opens at the interior surface of the basement wall to permit water to drain from the exterior well, through the wall and down the interior surface of the basement wall into a horizontal baseboard water drainage system of the type disclosed by U.S. Pat. No. 5,367,842 (DRYTRAK) or U.S. Pat. No. 5,501,044 (WATERGUARD). The area of the entry and vertical flow of the water down over the interior surface of the basement wall is covered by a flat plastic sheet which extends from the lower level of the window frame down into the baseboard water drainage system and is attached against the interior surface of the basement wall to enclose the water path.

While such systems can be concealed during the finishing of the basement walls, they are unsightly in an unfinished basement and, because they comprise a flat plastic sheet mounted flat on the interior basement wall they substantially restrict and limit the entry and flow of water to a degree that flooding can occur at times of excessive ground water conditions.

SUMMARY OF THE INVENTION

The present invention relates to an improved system for preventing the accumulation of water within exterior foundation areas, such as basement window wells, even under conditions of extreme groundwater flow. The present system comprises a combination of an upper horizontal conduit section which extends out through a bore in a basement wall and opens into the dry well area within an exterior basement window well, and has an opposed end which opens at the interior surface of the basement wall, and an elongate, vertical, stepped wall panel having a central stand-off conduit section and opposed vertical seat portions which sealingly-engage the interior surface of the basement wall and form therebetween the central, vertical, raised or stand-off water-conveying conduit section. The wall panel extends from an upper location, above the interior opening of the horizontal conduit, to a lower water-drainage location, preferably within a horizontal sub-floor or baseboard water drainage system, to permit the free flow of water from the window well, through the basement wall, and down between the raised or standoff vertical water-conveying conduit section and the wall surface into the water drainage system. The vertical stepped wall panel preferably is a rigid extrudate of a molding resin such as polyvinyl chloride or polypropylene, with an overall width of about 4 to 8 inches, a central section width of about 3 to 7 inches, a narrow standoff depth of about ⅜" to 9/16" from the wall, and opposed seat portions or vertical flanges having a width of ⅜" to 9/16" each, for bonding to the interior basement wall.

Other and further features, advantages, and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated in and constitute a part of this invention, illustrate one of the embodiments of the invention, and together with the description, serve to explain the principles of the invention in general terms. Like numerals refer to like parts throughout the disclosure.

DETAILED DESCRIPTION OF THE PREFERRED EMBODIMENTS

Figure 1:
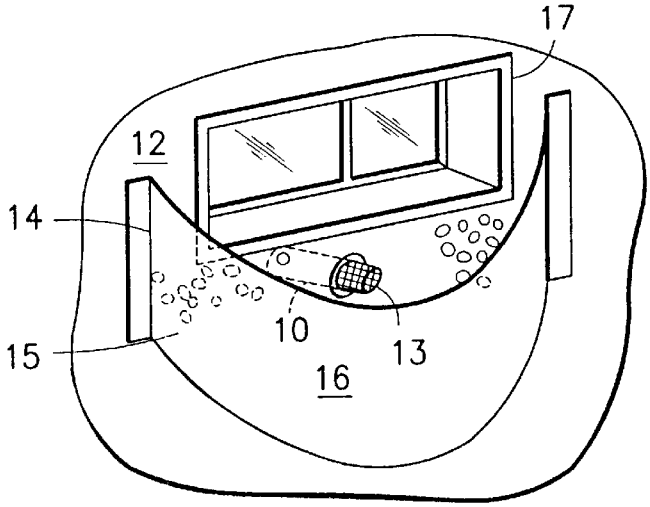
FIG. 1 is a perspective exterior view of a basement foundation wall, and a basement window and window well, showing the presence of a horizontal inlet conduit and debris strainer according to the present invention.
Figure 2:
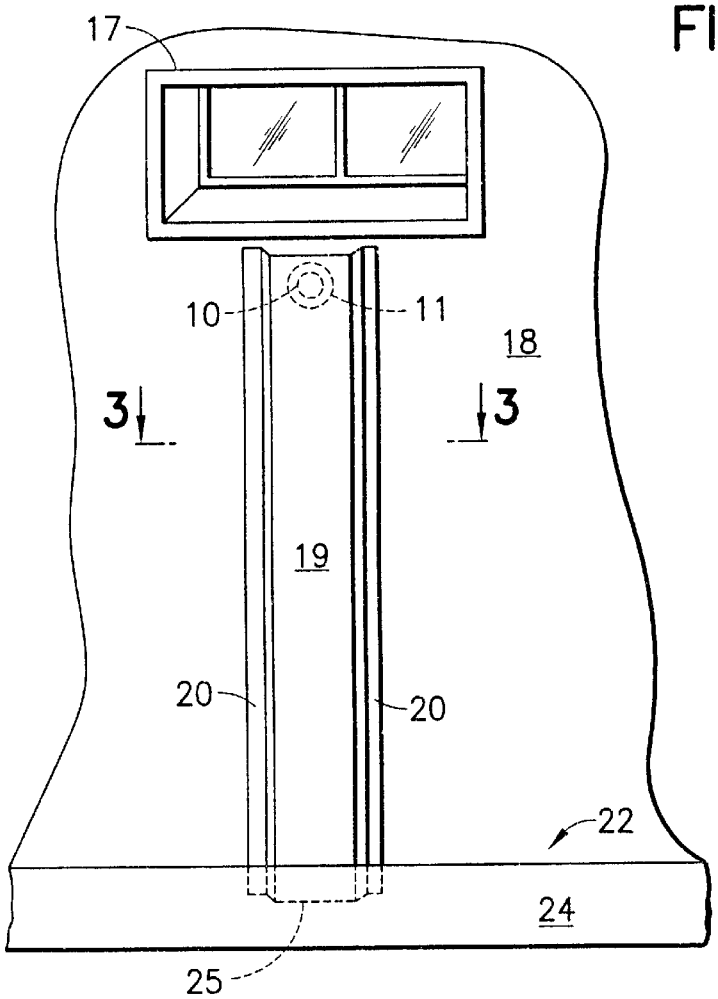
FIG. 2 is a perspective interior view of the basement window of FIG. 1 showing the presence of an elongate, stepped vertical wall panel with edge flanges bonded to the interior wall surface, with a central stand-off conduit section communicating between the inlet conduit opening, and a horizontal baseboard water drainage system.
Figure 3:
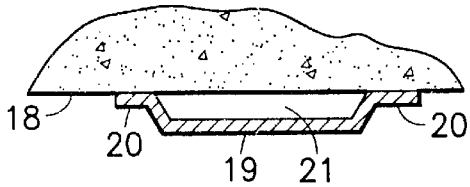
FIG. 3 is a cross-section of the vertical wall panel taken along the line 3—3 of FIG. 2.

Referring to FIGS. 1 to 3 of the drawings, the present window well water drainage system comprises an upper horizontal transverse conduit segment 10 bonded within a bore 11 through the basement foundation wall 12. The exterior end of the conduit segment 10 is capped with a debris strainer 13 and is buried below ground grade level 14 within a gravel dry-well area 15 of a window well enclosed by a peripheral retainer member 16 extending from the wall 12 at one side of the basement window 17 to the other.

As shown by FIG. 2, the horizontal conduit segment 10 opens at the interior surface 18 of the basement wall 12 within an elongate, stepped vertical wall panel 19 having opposed vertical seat flanges 20 having continuous flat surfaces which are bonded to the wall surface 18, such as with epoxy cement, and enclose the central, vertical, raised or offset trough area 21 which receives the inlet water from conduit segment 10, forming a vertical conduit between itself and the wall surface 18, and channels it down into the horizontal baseboard water drainage system 22.

Figure 4:
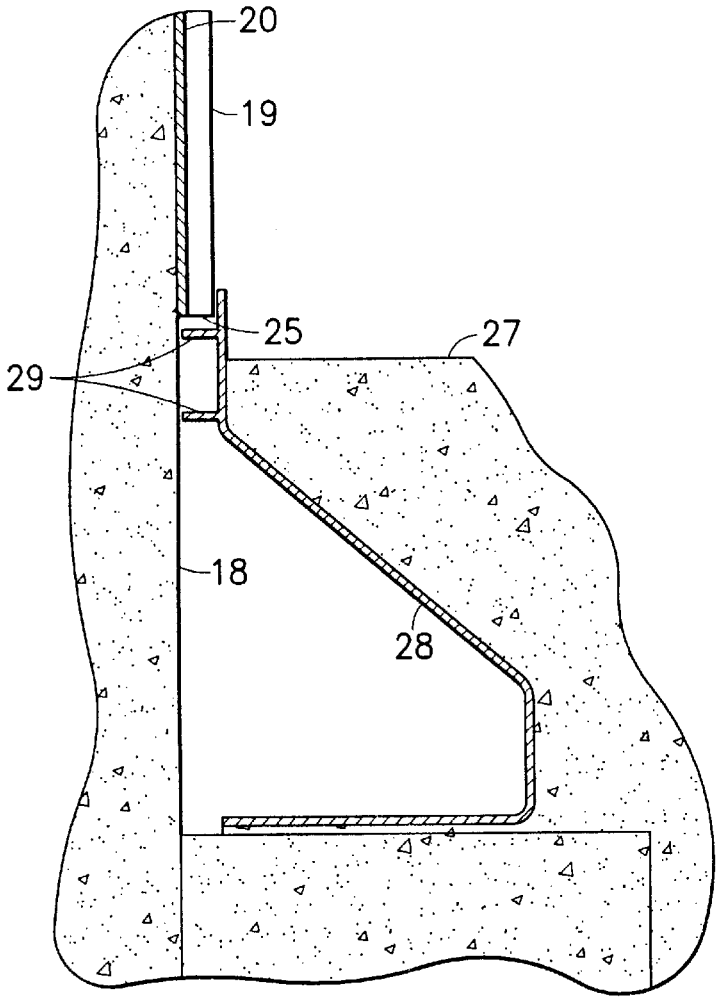
FIG.4 PRIOR ART
FIG. 4 is a cross-sectional view of an interior basement wall having bonded thereto an elongate vertical wall panel as shown in FIG. 2, communicating with a "WATERGUARD" horizontal baseboard conduit water drainage system.
Figure 5:
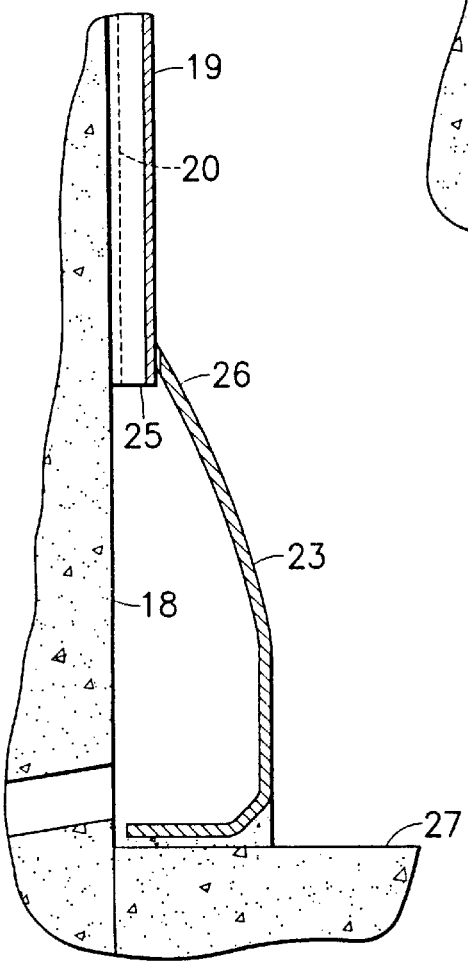
FIG.5 PRIOR ART
FIG. 5 is a cross-sectional view of an interior basement wall having bonded thereto an elongate vertical wall panel as shown in FIG. 2, communicating with a "DRYTRAK" horizontal baseboard conduit water drainage system.

The drainage system 22 may comprise an enclosed "DRYTRAK" baseboard conduit 23 bonded to the surface 27 of the basement floor, as disclosed in commonly owned U.S. Pat. No. 5,367,842 and illustrated by FIG. 5, or a "WATERGUARD" sub-floor conduit 28 having a vertical wall extension 24, with wall spacer means 29, behind which the outlet end 25 of the vertical conduit 19 extends, as illustrated by FIG. 4 and disclosed in commonly-owned U.S. Pat. No. 5,501,044. In the system illustrated by FIG. 5, a portion of the upper end 26 of the baseboard conduit 23 is cut away to closely conform to the shape of the vertical conduit 19 to neatly receive the outlet end 25 of the vertical panel 19 within the baseboard drainage conduit 23. This enables the automatic drainage of large volumes of exterior water from the dry well area 15 of an exterior window well, through the debris strainer 13 and horizontal conduit segment 10, into the trough area 21 between the vertical wall panel 19 and wall surface 18, and down into the baseboard drainage system 22. The latter conveys the water to a disposal area such as a dry well or, more preferably a sump pump.

The present wall-hugging vertical panel 19 is unobtrusive and neat in appearance so as not to be objectionable, particularly if painted the same color of the basement wall. In the case of finished basements, such as with 2×4 studs or 1×3 furring strips and paneled walls, the panel 19 is easily concealed between wall studs or furring strips and under paneling.

While the dimensions of the panel 19 are variable, preferred dimensions include the required length or height, generally from about 5 feet up to about 7 feet, a width of about 9 inches including the seat portions or flanges 20, each about ½ inch in width, and a standoff depth of about ½ inch. It should be understood that a plurality of spaced bores 11 and horizontal conduit segments 10 may be installed within wide window wells or within window wells or exterior dry well areas having severe water-accumulation and drainage requirements, in which case a wider vertical water drainage conduit 19 may be required.

It should be understood that the foregoing description is only illustrative of the invention. Various alternative other modifications may be made to the illustrated embodiments without departing from the scope and spirit of the invention as described in the specification and defined in the appended claims.

What is claimed is:

1. A system for relieving the accumulation of ground water from exterior locations adjacent the wall of a sub-terrainian room having a floor enclosed by a wall having an exterior surface and an interior surface, said system comprising a transverse bore through an upper section of said wall, a horizontal conduit segment bonded within said bore and having an inlet opening communicating with an exterior water accumulation area, immediately below ground level, and having an outlet opening communicating with the interior surface of the upper section of said wall, an elongate, stepped vertical panel having opposed flat vertical edge flanges which are bonded to the interior surface of the wall and which enclose a central standoff portion which forms a vertical water passageway between itself and the interior surface of the wall, said panel extending from (an) said upper wall (location) section, above the outlet opening of said horizontal conduit section, to a lower wall location communicating with a water-drainage means at the floor of said sub-terrainian room, whereby exterior ground water is permitted to flow through said horizontal conduit segment and vertically-downwordly beneath said vertical panel into said water drainage means to relieve any water accumulation at said exterior water accumulation area.

2. A system according to claim 1 in which the inlet opening of the horizontal conduit segment comprises a debris strainer.

3. A system according to claim 1 in which the water accumulation area is a window well.

4. A system according to claim 1 in which said elongate vertical panel comprises extruded plastic molding composition.

5. A system according to claim 1 in which said water drainage means comprises a horizontal baseboard conduit which conveys the groundwater below the floor of the sub-terrainean room.

* * * * *

UNITED STATES PATENT AND TRADEMARK OFFICE

CERTIFICATE OF CORRECTION

PATENT NO. : 5,970,664
DATED : 10/26/99
INVENTOR(S) : Janesky

It is certified that error appears in the above-identified patent and that said Letters Patent is hereby corrected as shown below:

Column 4, line 31, delete "(an)". (Claim 1)

Column 4, line 32, delete "(location)". (Claim 1)

Signed and Sealed this

Thirtieth Day of January, 2001

*Attest:*

*Attesting Officer*

Q. TODD DICKINSON

*Director of Patents and Trademarks*